United States Patent [19]

Morris

[11] Patent Number: 4,491,327

[45] Date of Patent: Jan. 1, 1985

[54] GAME WITH THROWING PIECE

[76] Inventor: Leycester W. Morris, 3208 W. Webster, Royal Oak, Mich. 48072

[21] Appl. No.: 529,157

[22] Filed: Sep. 2, 1983

[51] Int. Cl.[3] ..... A63B 71/02

[52] U.S. Cl. ..... 273/343; 273/427; D21/4; D21/50; D21/203

[58] Field of Search ..... 273/336–339, 273/427, 428; D21/4, 50, 203

[56] References Cited

U.S. PATENT DOCUMENTS

| | | | |
|---|---|---|---|
| D. 220,272 | 3/1971 | Triplett | D21/50 |
| 1,520,039 | 12/1924 | Wahl | 273/427 |
| 3,762,710 | 10/1973 | De Coninck | 273/427 |
| 3,774,911 | 11/1973 | Benfield | 273/343 |
| 3,917,269 | 11/1975 | Paquette | 273/343 |

*Primary Examiner*—Paul E. Shapiro

*Attorney, Agent, or Firm*—Barnes, Kisselle, Raisch, Choate, Whittemore & Hulbert

[57] ABSTRACT

A competitive game which includes spaced, U-shaped pipe wickets and a throwing piece in the form of an S which can catch on a horizontal run of the wicket or on the vertical legs or on both to provide varying score points.

3 Claims, 7 Drawing Figures

GAME WITH THROWING PIECE

FIELD OF INVENTION

A game wherein spaced wickets are targets for a throwing piece.

BACKGROUND OF INVENTION

The game of horseshoes is well known and started with the throwing of discarded horseshoes at an iron stake placed in the center of spaced pits. The game to be disclosed as the present invention also involves a throwing piece, but the spaced targets are a U-shaped wicket, the legs of which are driven into the ground or otherwise supported. The throwing piece is an S-shaped unit designed to cath on the target wicket in a number of different ways.

It is thus an object to provide a game which can hold the interest of children and adults alike and which provides a variety of piece positions in connection with the scoring procedures.

Various objects of the invention will be apparent in the following description in which the principles of the invention are set forth, together with details to enable persons skilled in the art to construct and practice the invention all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 5:
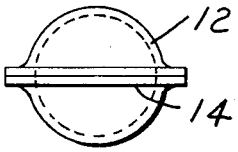
FIG. 5, a view on line 5—5 of FIG. 4.
Figure 5:
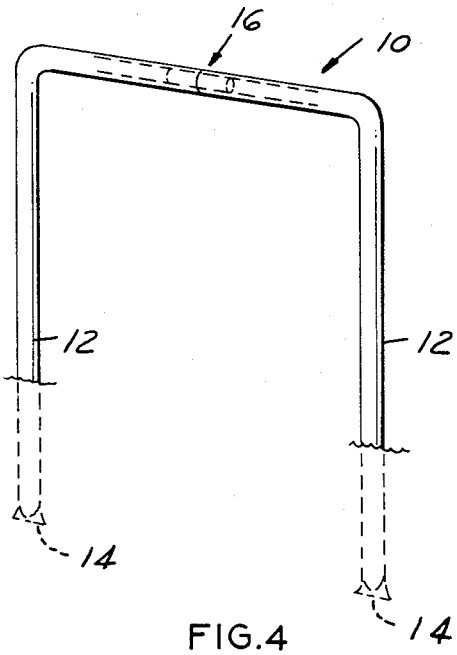
Figure 4:
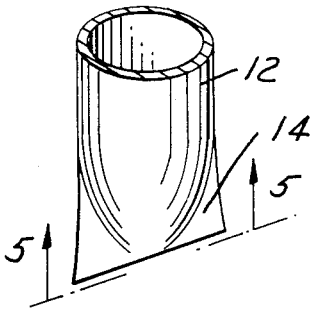
FIG. 4, a detailed view of the bottom end of a wicket leg.

The Wickets:

The wickets 10 are U-shaped elements preferably formed of steel pipe having a $\frac{3}{4}''$ diameter and a wall thickness of 0.003". Each wicket may weigh about $1\frac{1}{2}$ pounds. Since in most cases the wicket legs must be driven into the ground, the steel pipe resists deformation. The steel also provides a wicket heavy enough to be stable in use. The legs 12 of the wickets are preferably about 19 to 21" long and have the bottom ends 14 pinched in and closed at the bottom to be flat in the plane of the wicket as shown in FIGS. 4 and 5. This formation prevents the legs from filling with dirt and also prevents the legs from spreading as they are driven in to the ground.

Figure 1:
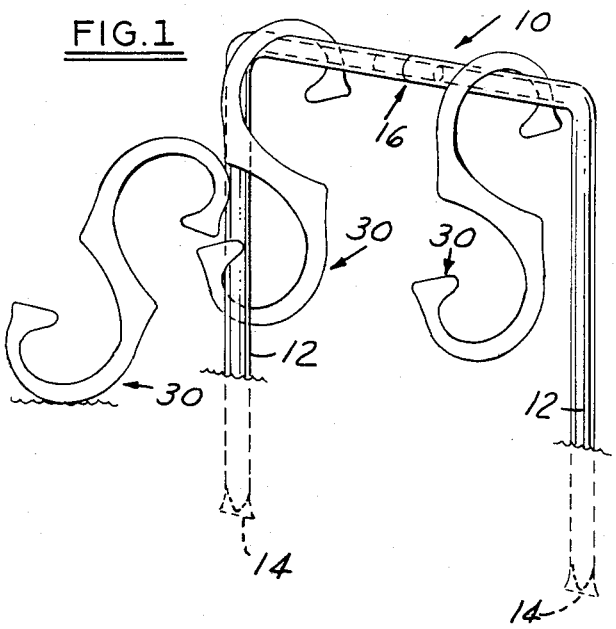
FIG. 1, a view of the spaced wickets used in the game and the throwing piece in various positions.

The cross bar of the wicket is preferably about 14" long. The inside diameter should exceed the length of the throwing piece. The wicket is driven into the ground to leave about 12" inches between the ground and the bottom of the cross bar. This distance should be such that the throwing piece will not touch the ground when swinging on the cross bar. About $\frac{1}{2}''$ clearance is desirable. If the wicket is formed of a single piece of pipe, the corners can be collapsed to strengthen the structure. The wicket may also be made of L-shaped pieces which telescope together at the bight of the U as at 16 in FIG. 1.

Figure 2:
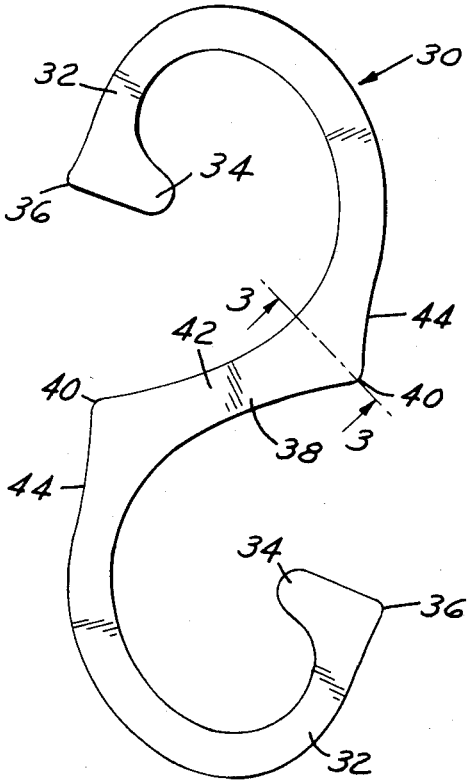
FIG. 2, a view of the throwing piece used in the game.

The Throwing Piece:

The throwing piece is an S-shaped unitary piece about, as an example, $12\frac{1}{2}''$ in overall length and $5\frac{1}{4}''$ in width. The return ends of the S bend back on the main curve portion and have a hooked portion which extends inwardly in a direction to partially close the loop in the ends of the S. A slight outward projection is also formed opposite this hooked portion. In FIG. 2, the throwing piece 30 has the return ends 32, the inwardly extending portion 34 to form the hooks, and slight outward projection 36. At the midportion of the connecting curve 38 are corners 40.

Figure 6:
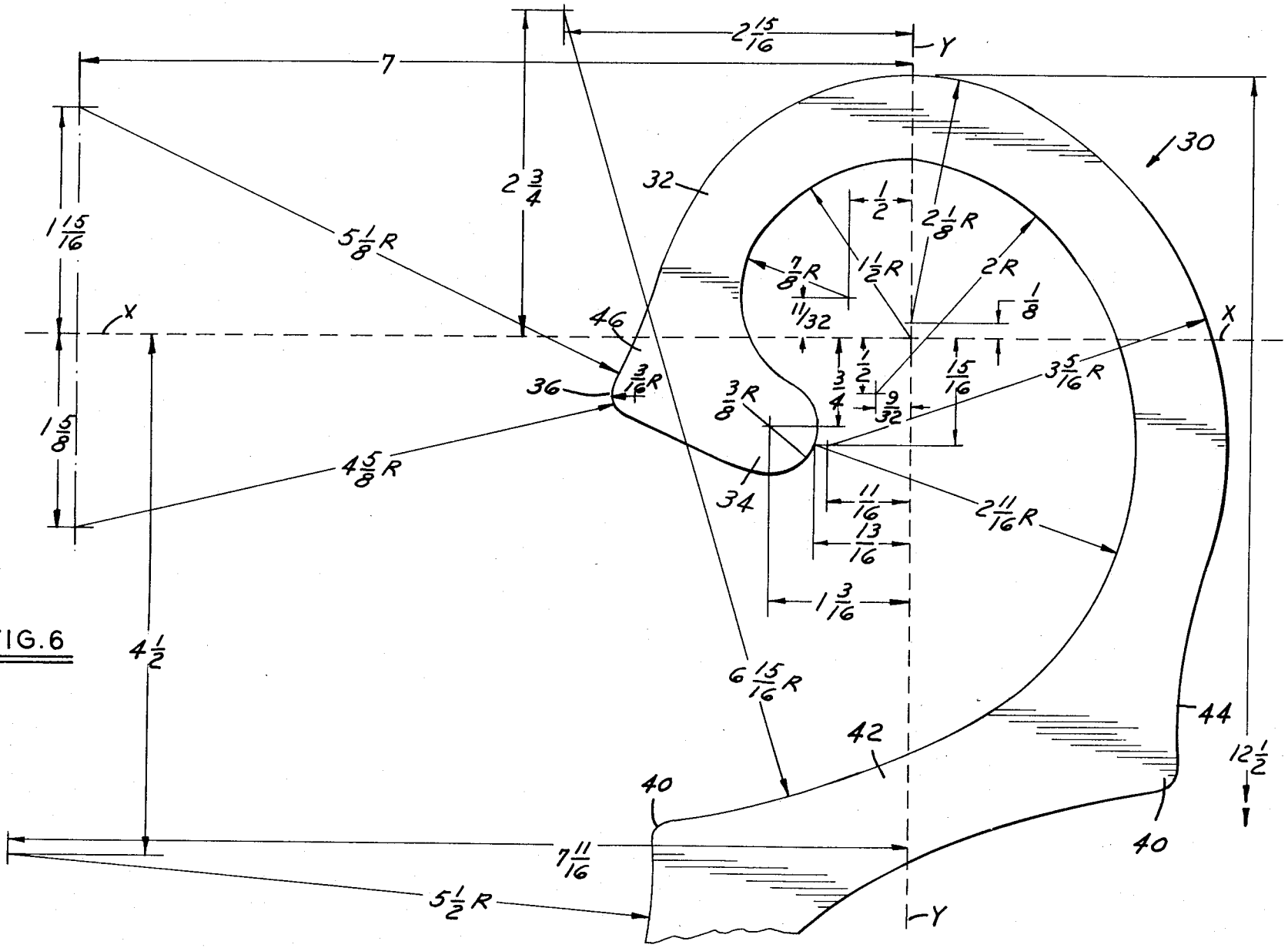
FIG. 6, an enlarged detailed view of one end of the throwing piece.

In FIG. 6, the details of one end of the S-shaped throwing piece are shown. Two perpendicular dash reference lines X—X and Y—Y are provided. The various radii shown are all located with relation to these reference lines. In general terms, the S-shaped throwing piece 30 has two return curved ends connected by a center bar 42 which approaches horizontal as viewed in the drawing and terminates at corners 40. The inside curve of the ends starting at the center bar has continuously decreasing radii from about 7" down to $\frac{7}{8}''$. The outside radii graduate from a reverse curve 44 of $5\frac{1}{2}$ to the outside curve with radii of 3 5/16", $2\frac{1}{8}''$ ending in a slight reverse curve 46 of $5\frac{1}{8}''$. The small radius of $\frac{7}{8}''$ terminates in a rounded hook or nose 34 having a $\frac{3}{8}''$ radius.

Figure 3:
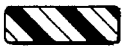
FIG. 3, a sectional view on line 3—3 of FIG. 2.

The throwing piece is preferably formed of plywood or plastic of sufficient weight that it will not be materially affected in its flight by the wind. A cross-section of the piece is shown in FIG. 3 taken on line 3—3 of FIG. 2.

Playing the Game:

The object of the game is to throw the S-pieces to hook on the cross-bar of the wicket, encircle the legs, or come as close to the legs as possible.

The wickets are driven into the ground using a plastic or wooden mallet to a depth such that the cross-bar is positioned to allow the throwing piece to clear the ground by about $\frac{1}{2}''$ when hooked over the cross-bar. The wickets are preferably placed about 15' apart in planes and parallel to each other. This distance may vary depending on the skill of the players. A round is completed when two players have thrown two S-pieces. Doubles may be played if desired. Various rules may be utilized. The following is one example of a set of rules.

A game is completed when one player or one team has 21 points after the last round. If the points scored during the last round would cause a player's score to go over 21, these extra points will be deducted from the player's previous score rather than be added and the game continues until a player ends a round at exactly 21.

The S-piece is held by one end and flipped so that it spins through the air. A vertical throw may hook the cross-bar. A horizontal throw is more likely to catch on a leg of the wicket. The player who scores the last point throws first in each round.

A single point is scored when the S-piece is closest to either leg. A double point is scored if the piece is lying between the legs and closer to each than his opponents. A leaner may also be a double point. A ringer can be a triple point play. A ringer-point can tally 4 points when the shoe is a ringer on one leg and closest to the other leg. A ringer-leaner can be a 5 point play. A swinger (S-piece on the cross-bar) is a 7 point throw and a swinger-ringer (one end on cross-bar and the other hooked around a leg) is a 10 point play.

Equal points for each player a round cancel each other. A high point score in a single round (7 or 10) cancels all the opponent's score unless he has had a 10 point swinger-ringer.

As previously indicated, other rules and point scores may be devised to suit the age group or skill of the players. The maximum distance from a leg to score can be measured from any two spaced points on a throwing piece as predetermined in the rules.

Figure 7:
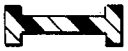
FIG. 7, a view of a modified section of a throwing piece.

In FIG. 7, a modified cross-section is illustrated for the throwing piece. The piece is molded plastic with an I-section, the web being about one-half the total thickness of the piece.

The throwing piece may be made of any suitable material which provides the proper weight and strength. In addition to plastic and plywood, aluminum or magnesium might be used.

I claim:

1. A game which comprises in combination (a) a U-shaped wicket having a support to locate the wicket as an inverted U above the ground with upright legs and a horizontal bight as a cross-bar, and (b) a throwing piece to be cast at an upright wicket comprising an S-shaped generally symmetrical member, (c) the S-shaped throwing piece having a cross member extending essentially transverse of the S between the loops and ending in a corner formation.

2. In a game which utilizes a U-shaped wicket as an inverted U above the ground with upright legs and a horizontal bight as a cross-bar, and a throwing piece to be cast at the upright wicket comprising an S-shaped, generally symmetrical member, that improvement in which the throwing piece has a central axis passing through the center of two symmetrical loops, the loops being formed on each side of a central cross-member which is angled to said central axis, the inside of each loop being composed of a continuously changing, blended curve with a series of ensmalling radii to the end of the loop, which end is directed toward said axis.

3. A game as defined in claim 2 in which the outer perimeter of each loop terminates in a corner with an inwardly extending surface angled away from said corner toward said central axis and toward said cross-member.

* * * * *